US007381307B2

(12) United States Patent
Silakoski

(10) Patent No.: US 7,381,307 B2
(45) Date of Patent: Jun. 3, 2008

(54) METHOD OF MANUFACTURING A PRESS FELT, AND A PRESS FELT, WITH THE SHAPE OF A CLOSED LOOP

(75) Inventor: Leena Silakoski, Kangasala (FI)

(73) Assignee: Tamfelt OYJ ABP, Tampere (FI)

( * ) Notice: Subject to any disclaimer, the term of this patent is extended or adjusted under 35 U.S.C. 154(b) by 306 days.

(21) Appl. No.: 10/537,613

(22) PCT Filed: Dec. 15, 2003

(86) PCT No.: PCT/FI03/00957

§ 371 (c)(1),
(2), (4) Date: Jun. 3, 2005

(87) PCT Pub. No.: WO2004/055265

PCT Pub. Date: Jul. 1, 2004

(65) Prior Publication Data

US 2006/0016571 A1 Jan. 26, 2006

(30) Foreign Application Priority Data

Dec. 18, 2002 (FI) ..... 20022226

(51) Int. Cl.
*D21F 7/10* (2006.01)
*B32B 5/06* (2006.01)

(52) U.S. Cl. ..... 162/358.2; 162/900; 162/904; 442/270; 428/58; 28/110; 28/142

(58) Field of Classification Search ..... 139/383 A, 139/383 AA, 425 A; 162/358.1, 358.2, 900–904, 162/199, 348; 428/192, 193, 212, 222, 223, 428/57–62; 442/268–275, 203–208, 192–195; 28/110, 141, 142; 34/116, 123
See application file for complete search history.

(56) References Cited

U.S. PATENT DOCUMENTS

| | | | | |
|---|---|---|---|---|
| 2,428,097 | A | | 9/1947 | Roslund |
| 4,090,897 | A | | 5/1978 | Minick |
| 4,501,782 | A | * | 2/1985 | Weatherly et al. ..... 428/57 |
| 5,360,656 | A | * | 11/1994 | Rexfelt et al. ..... 428/193 |
| 5,464,488 | A | | 11/1995 | Servin |
| 5,713,399 | A | * | 2/1998 | Collette et al. ..... 139/383 AA |
| 5,731,063 | A | | 3/1998 | Schultz et al. |
| 6,162,518 | A | | 12/2000 | Korfer |

FOREIGN PATENT DOCUMENTS

| | | | |
|---|---|---|---|
| GB | 902503 | | 4/1960 |
| JP | 2000-027089 A | | 1/2000 |
| WO | WO 02/053833 | * | 7/2002 |

OTHER PUBLICATIONS

English language translation of foreign Office Action.

* cited by examiner

*Primary Examiner*—Eric Hug
(74) *Attorney, Agent, or Firm*—Oliff & Berridge, PLC

(57) ABSTRACT

The invention relates to a method of manufacturing a press felt and to a press felt and a base fabric. The base fabric comprises at least a first planar compo-nent (4), which includes a first transverse (CMD) joining edge area (11) and a second transverse joining edge area (12). The joining edge areas (11, 12) are arranged to overlap each other and attached to each other undetachably.

18 Claims, 5 Drawing Sheets

METHOD OF MANUFACTURING A PRESS FELT, AND A PRESS FELT, WITH THE SHAPE OF A CLOSED LOOP

BACKGROUND OF THE INVENTION

The invention relates to a method of manufacturing a press felt, the method comprising at least the following steps of: forming a base fabric whose at least one layer comprises at least a first planar component, which is formed from a plurality of longitudinal yarns that travel in the machine direction and transverse yarns that travel in the cross machine direction, and providing the first component with a first transverse joining edge area and a second transverse joining edge area; arranging the first and the second transverse joining edge area of the first component so that they overlap each other; and forming a base fabric with the shape of a closed loop; and attaching at least one batt fibre layer to the base fabric with the shape of a closed loop; and the method comprising attaching the joining edge areas to each other undetachably before the attachment of the batt fibre layer.

The invention further relates to a press felt for a paper machine press section, the press felt comprising: a base fabric, which includes a plurality of longitudinal yarns that travel in the machine direction and a plurality of transverse yarns that travel in the cross machine direction and whose at least one layer is provided with at least a first planar component, which includes a first transverse joining edge area and a second transverse joining edge area and where the joining edge areas are connected to each other, and at least one batt fibre layer, and where the first and the second joining edge area of the first component are arranged so that they overlap each other, and where the joining edge areas are attached to each other undetachably before the attachment of the batt fibre layer.

The invention further relates to a base fabric for a press felt, comprising: a plurality of longitudinal yarns that travel in the machine direction; a plurality of transverse yarns that travel in the cross machine direction; at least a first planar component in at least one base fabric layer, and the first component includes at least a first transverse joining edge area and a second transverse joining edge area, and where the joining edge areas are connected to each other, and the first and the second joining edge area of the first component are arranged to overlap each other; and the joining edge areas are attached to each other undetachebly.

Depending on the press structure, the press section of the paper machine employs a press felt on one or both sides of the web to be dried, into which the water in the web may be absorbed in the pressing phase. The purpose of the press felt is to transport the water away in its structure without letting it back into the web. In the actual pressing, the paper web is conveyed on the felt into an opening between two cylinders, i.e. into a nip. The structure of the felt should allow good absorption of water into the felt in the nip. Press felts include a base fabric which, for example, provides the felt with a necessary space for water. To obtain a smooth felt surface, batt fibre is attached at least onto the base fabric surface facing the web. The base fabric is typically manufactured by weaving. The base fabric may be directly woven into an endless loop. In that case, however, the width of the weaving machine restricts the length of the base fabric to be manufactured. In addition, the fabric may be woven as a plane. This enables manufacturing base fabrics provided with seam loops. By connecting the joining ends of the base fabrics, a base fabric with the shape of an endless loop can be formed.

The seam loops may, however, cause markings on the web to be dried. In addition, adherence of batt fibre to the area provided with seam loops may also pose a problem.

BRIEF DESCRIPTION OF THE INVENTION

The object of the invention is to provide a novel and improved method of manufacturing a press felt, press felt and base fabric for a press felt.

The method according to the invention is characterized by pressing the joining edge areas of the first component against each other during the attachment by a predetermined force so that the thickness of the overlapping joining edge areas substantially corresponds to the thickness of the rest of the first component.

The press felt according to the invention is characterized in that the joining edge areas of the first component have been pressed against each other and that the thickness of the overlapping joining edge areas substantially corresponds to the thickness of the rest of the first component.

The base fabric according to the invention is characterized in that the joining edge areas of the first component have been pressed against each other and that the thickness of the overlapping joining edge areas substantially corresponds to the thickness of the rest of the first component.

The invention is based on the idea that the base fabric comprises at least one planar component provided with a first transverse joining edge area and a second transverse joining edge area. The joining edge areas are arranged to overlap each other, after which they are attached to each other undetachably. Such an overlapping joint makes seam loops and other similar joining members unnecessary.

An advantage of the invention is that it facilitates and speeds up the manufacture of a planar component since the component needs not be provided with seam loops in the weaving machine. Since seam loops are not needed to connect the joining edges, the joining edges can be formed anywhere in the planar component. The seam loops, however, have to be formed already in connection with weaving. In addition, the joint according to the invention provides a good base to which batt fibre can be attached. The joint is also firm and quick to manufacture. It is relatively easy to automate the implementation of the joint.

A preferred embodiment of the invention is based on the idea that at least one joining edge area of the planar component is provided with a thinned portion, where the density of transverse yarns is smaller in a predetermined section starting from the end of the component than in the rest of the component. Thanks to the thinning, the thickness of the overlapping joint can be decreased so that it does not significantly differ from the rest of the component structure. The thinning also affects the permeability of the overlapping joint so that it does not significantly differ from the rest of the component structure.

A preferred embodiment of the invention is based on the idea that thinning is implemented by removing several transverse yarns from the joining edge area after the manufacture of the component.

A preferred embodiment of the invention is based on the idea that a smaller number of transverse yarns are arranged in the joining edge areas than in the rest of the component during the manufacture of the planar component.

A preferred embodiment of the invention is based on the idea that the overlapping joining edge areas are attached to each other by welding.

A preferred embodiment of the invention is based on the idea that at least the portion with overlapping joining edge areas is provided with an attachment area, where the joining edge areas have been attached to each other undetachably. In addition, the boundary surface between the attachment area and the rest of the first component is made non-linear. Since the boundary surface is not clearly distinguishable, markings can be prevented.

A preferred embodiment of the invention is based on the idea that at least the portion with overlapping joining edge areas is provided with an attachment area, where the joining edge areas have been attached to each other undetachably, and the attachment area is provided with several attachment points, which form a pattern that imitates the pattern on the base fabric surface. This way markings can be avoided. Furthermore, thanks to the attachment points, permeability in the attachment area may substantially correspond to that in the rest of the base fabric.

BRIEF DESCRIPTION OF FIGURES

The invention will be described in greater detail in the accompanying drawings, in which.

For the sake of clarity, the figures illustrate the invention in a simplified manner. Like reference numbers refer to like parts in the figures.

DETAILED DESCRIPTION OF THE INVENTION

Figure 1:
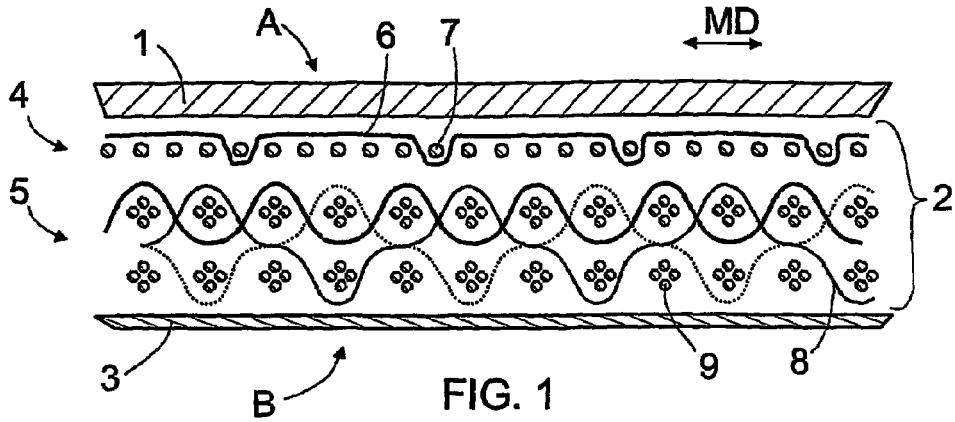
FIG. 1 illustrates a schematic cross-section of a press felt according to the invention in the paper machine direction MD.

FIG. 1 illustrates a press felt according to the invention as a section in the paper machine direction MD. The felt illustrated in the figure comprises four layers attached to one another. On the felt surface A facing the web, there is a first batt fibre layer 1 as the outermost layer. Below the first batt fibre layer, there is a base fabric 2 consisting of two components, and further at the bottom of the felt, i.e. on the surface B facing the paper machine, there is a second batt fibre layer 3. The first batt fibre layer 1 prevents the generation of markings, i.e. a pattern caused by the weave of the base fabric, onto the web surface. In addition, water retention properties of the felt can also be affected by batt fibre. The first batt fibre layer 1 may consist of two or more thin layers, in which case there may be finer batt fibre on the surface of the batt fibre layer 1 and coarser batt fibre below it. The second batt fibre layer 3 at the bottom of the felt is not necessary.

The base fabric 2 may comprise one or more superimposed components 4 and 5. The components 4 and 5 may be woven in different phases and arranged one on top of the other before the batt fibre layers 1, 3 are attached. The base fabric 2 according to FIG. 1 comprises a one-layer surface component 4 and a two-layer bottom component 5. Thus the base fabric 2 has a laminate structure. It should, however, be noted that the base fabric 2 may consist of only one component, or on the other hand, there may be more than two superimposed components. The first component 4 in the base fabric is woven from longitudinal yarns 6 that travel in the machine direction MD and transverse yarns 7 that travel in the cross machine direction CMD using a suitable weave. Correspondingly, the second component 5 is woven from longitudinal yarns 8 that travel in the machine direction MD and transverse yarns 9 that travel in the cross machine direction CMD. For the sake of clarity, the figure illustrates only some of the yarns belonging to the layers. In the solution according to FIG. 1, yarns 6, 7 and 8 are monofilaments and yarns 9 are plied monofilaments. The structure and material may be selected for the yarns on the case-by-case basis. Thus they may be monofilaments, plied monofilaments or multifilaments. The yarns may be made of a suitable plastic material, such as polyamide (PA).

Figure 2:
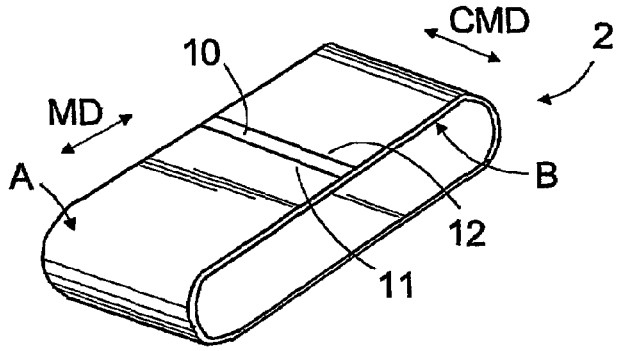
FIG. 2 is a schematic perspective view of a base fabric according to the invention, FIGS. 3 to 5 schematically illustrate an alternative of forming a base fabric according to the invention, FIGS. 6 to 8 schematically illustrate a way of forming a transverse seam for the base fabric component according to the invention as a cross-section in the machine direction MD.

FIG. 2 illustrates a base fabric 2 with the shape of a closed loop. As appears from the figure, the base fabric 2 includes a seam area 10 in the cross machine direction CMD that connects the first transverse joining edge area 11 and the second transverse joining edge area 12 of the base fabric 2 to each other. At least one layer of the base fabric may be formed from several planar components connected to each other's extensions, in which case there are several transverse seam areas 10. After the base fabric 2 with the shape of a closed loop has been formed, it may be treated thermally and the batt fibre layers intended for it can be attached by needling, for instance. Alternatively, the base fabric 2 components may be treated with heat before the assembly. The attachment of batt fibre may increase the strength of the seam area 10.

Figure 3:
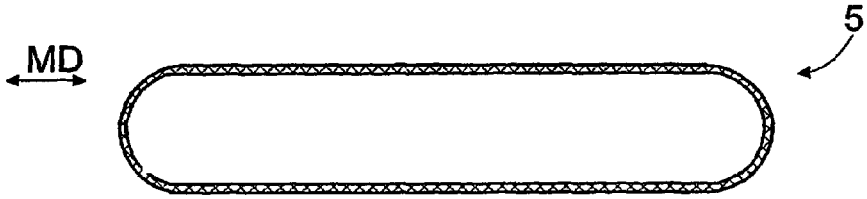
Figure 4:
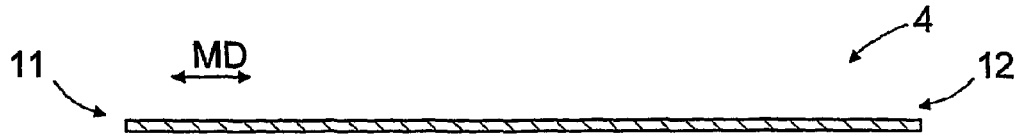
Figure 5:
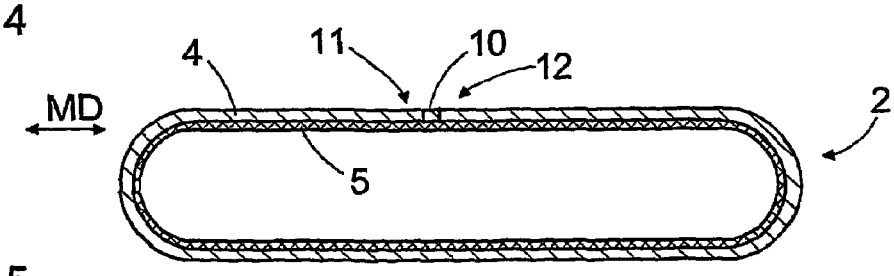

FIGS. 3 to 5 illustrate one way of forming the base fabric 2. FIG. 3 illustrates the second base fabric 2 component 5, which is manufactured as an element with the shape of a closed loop. FIG. 4 illustrates the first base fabric 2 component 4, which has been shaped into a planar element, whose width substantially corresponds to the width of the press felt and which comprises a first joining edge area 11 and a second joining edge area 12. The components 4 and 5 may have been manufactured by weaving in separate phases. The base fabric 2 is assembled by arranging the first planar component 4 on top of the second component 5 with the shape of a closed loop. The joining edge areas 11 and 12 of the first component 4 are arranged to overlap over a certain predetermined distance, after which they are attached to each other. The attachment can be implemented by adhesive, by needling, by melting or by welding. The structure of the joining edge areas 11 and 12 may correspond to the rest of the component 4 structure or they may have a thinner structure, as will later appear from FIGS. 7 to 13. In addition, the joining edge areas 11 and 12 may also be attached to the second component 5.

An advantage of the structure shown in FIG. 5 is that the uniform second component 5 sustains well the forces to which it is subjected in the machine direction MD during the run. In that case, the seam area 10 in the first component 4 does not necessarily need to sustain the forces generated in the machine direction MD during the operation, but it is sufficient that it sustains the mechanical stresses generated in the manufacturing process, thus facilitating the handling of the base fabric 2. The other properties of the base fabric 2, such as density and surface properties, can be affected by the first component 4. The first planar component 4 is easier to manufacture than a loop-shaped component. In addition, there are several alternatives for selecting the structure and properties for the planar component 4.

Figure 6:
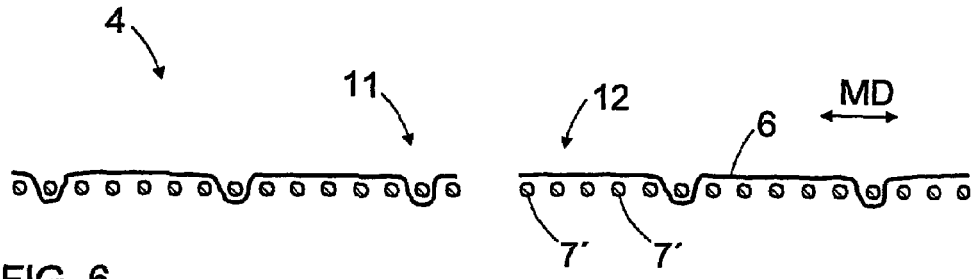
Figure 7:
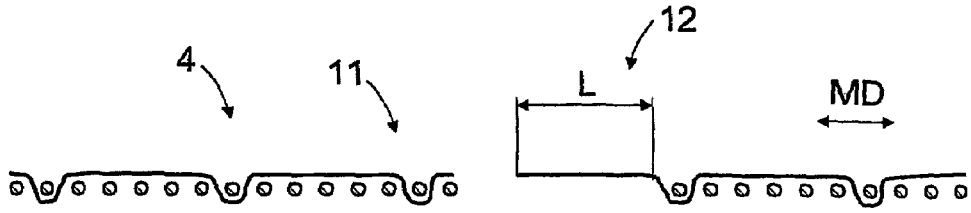
Figure 8:
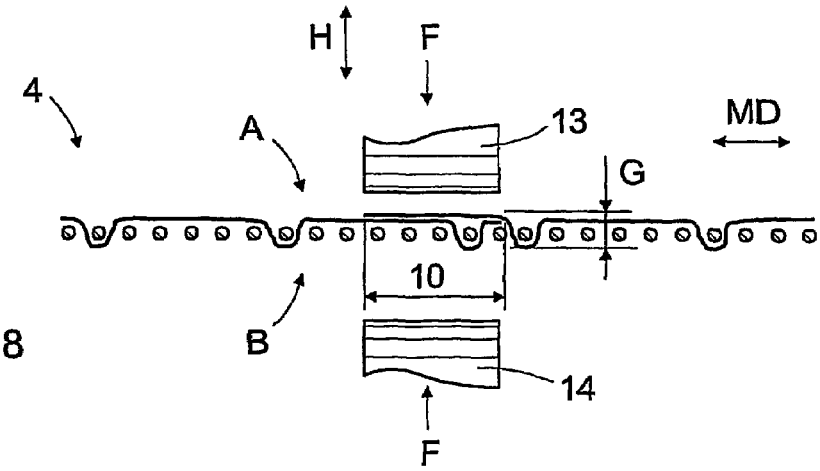

FIGS. 6 to 8 illustrate one way of forming a transverse CMD seam area 10. FIG. 6 illustrates the first joining edge area 11 and the second joining edge area 12 of the planar component 4. As appears from F*igure* 7, transverse yarns 7' can be removed from a portion L of the second joining edge area 12 corresponding to the width L of the seam area 10 starting from the end of the joining edge area 12. The number of yarns 7' to be removed may be 1 to 10, for instance. The number of the yarns 7' to be removed depends, for example, on the yarn thickness and the weave of the component 4. The length of portion L may vary between 2 and 100 mm. Preferably, the length of portion L is between 5 and 20 mm. The joining edge area 12 from which yarns have been removed comprises only longitudinal yarns 6. After this, the second joining edge area 12 can be arranged to overlap the first joining edge area 11 as shown in FIG. 8 in direction H, which is transverse to the component 4 surface. After this, the joining edge areas 11 and 12 can be attached to each other. The attachment can be performed by ultrasonic welding. During the welding, the joining edge areas 11 and 12 can be pressed against each other between opposing surfaces 13 and 14 included in the welding device. The welding device may include discoid opposing surfaces 13, 14, which can be rolled in the transverse CMD direction during the welding. Alternatively, the opposing surfaces can be moved step by step. The shape of the opposing surfaces can be selected on the case-by-case basis so as to obtain different seam shapes as shown in FIGS. 14 to 18. For the sake of clarity, the opposing surfaces are shown at a distance from surfaces A and B of the component in FIG. 8. The press force F can be determined such that the component 4 is at least slightly compressed in the seam area 10, in which case the seam area thickness G does not substantially differ from the thickness of the other parts in the component 4. Furthermore, compression contributes to the attachment of the welded parts to each other. Compression can also be employed in other welding and attachment techniques. One feasible alternative is to compress at least one joining edge area 11, 12 in advance before the areas are superimposed.

Figure 9:
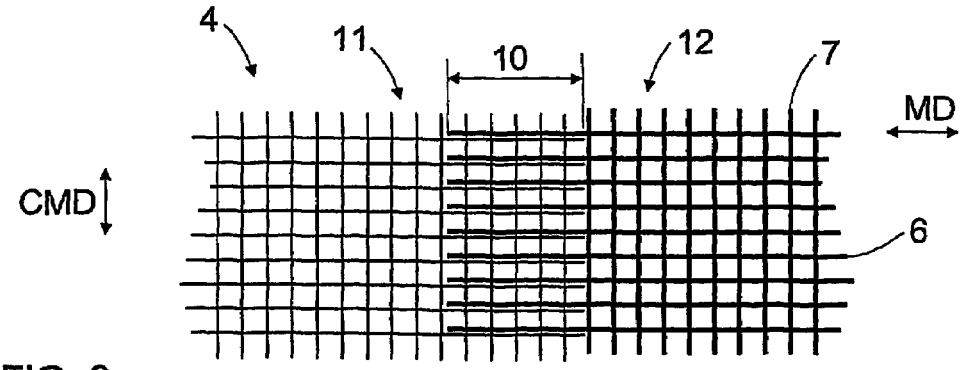
FIG. 9 is a schematic top view of the seam according to FIG. 8, FIGS. 10 and 11 are schematic top views of a second way of forming a seam according to the invention.

FIG. 9 is a top view of the seam area 9. For the sake of clarity, the second joining edge area 12 of the component 4 is illustrated with thicker lines in FIGS. 9 to 13. The width of the seam area 10 is preferably between 5 and 20 mm.

Figure 10:
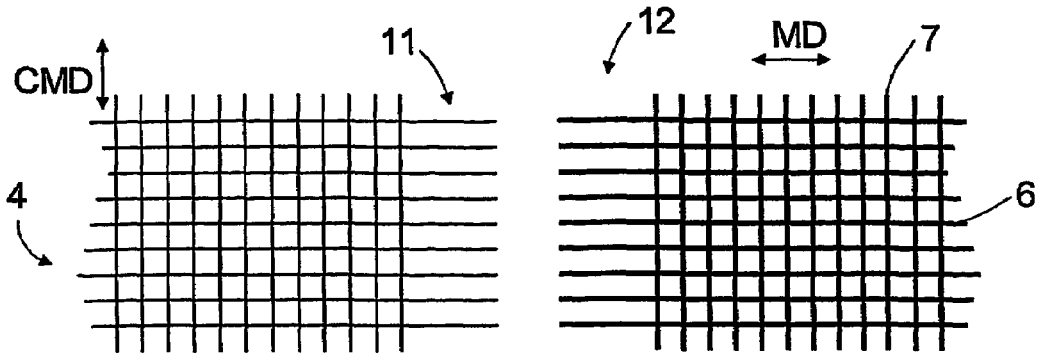
Figure 11:
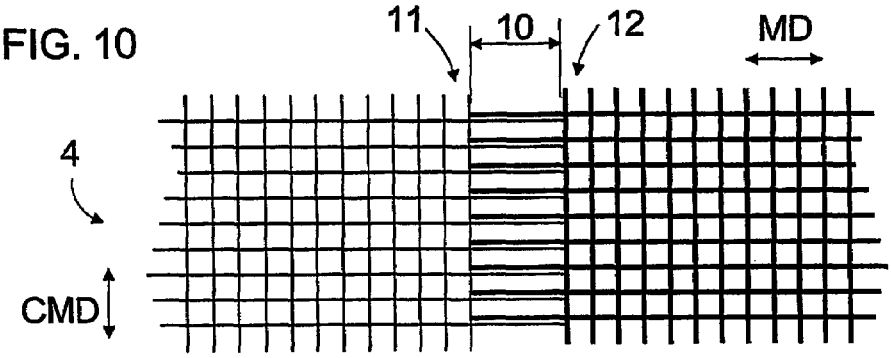

FIG. 10 illustrates a solution where both the first joining edge area 11 and the second joining edge area 12 of the component 4 have been thinned by removing transverse yarns 7 from them. Yarns 7 may preferably be removed from a portion of about 5 to 20 mm. After this, the joining edge areas 11 and 12 are arranged to overlap as shown in FIG. 11, in which case the longitudinal yarns of the first joining edge area 11 and the second joining edge area 12 are next to each other or one on top of the other in the seam area 10. After this, the joining edge areas 11 and 12 are attached to each other undetachably. The joining edge areas 11, 12 may be have an equal length, but in some cases they may be of different lengths.

Figure 12:
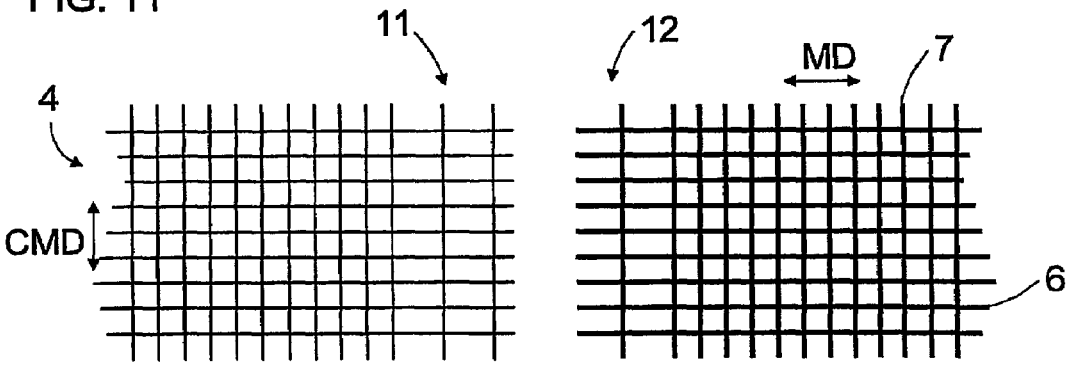
FIGS. 12 and 13 are schematic top views of a third way of forming a seam according to the invention.
Figure 13:
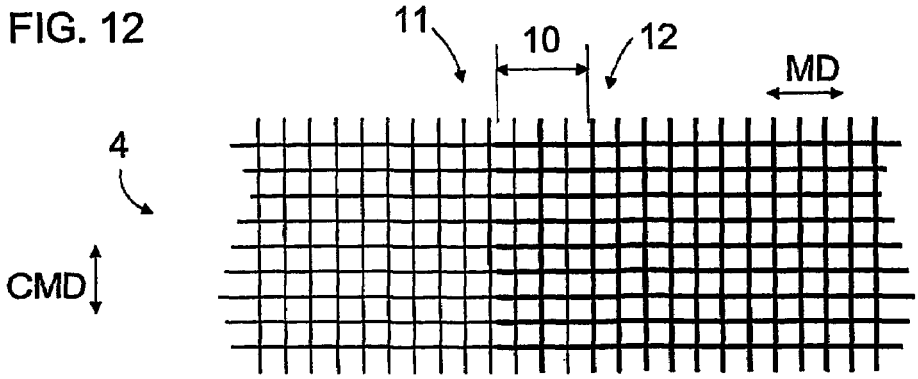

FIG. 12 illustrates a further way of forming thinned joining edge areas 11 and 12 for the overlapping joint of the invention. Alternatively, only one joining edge area 11, 12 is thinned. The thinning may be implemented by weaving transverse yarns less densely in the joining edge areas 11, 12 than in the other parts of component 4. The density of transverse yarns in the joining edge area 11, 12 may be 50 yarns/10 cm, and in the other parts of the component 4 the density may be 100 yarns/10 cm, for instance. In some cases the density of transverse yarns may gradually increase starting from the end of the component, finally corresponding to the rest of the component structure. FIG. 13 illustrates the situation after the joining edge areas 11, 12 have been arranged to overlap.

Figure 14:
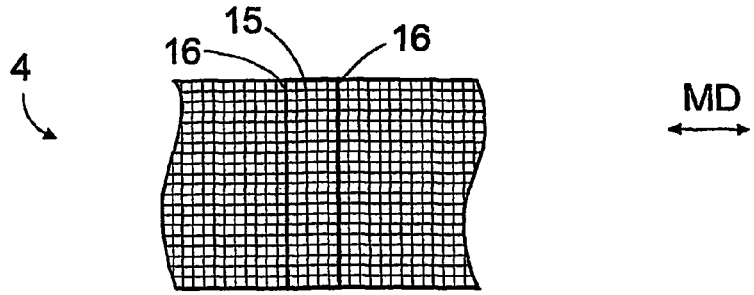
FIGS. 14 to 16 are schematic top views of feasible shapes for an attachment area.
Figure 15:
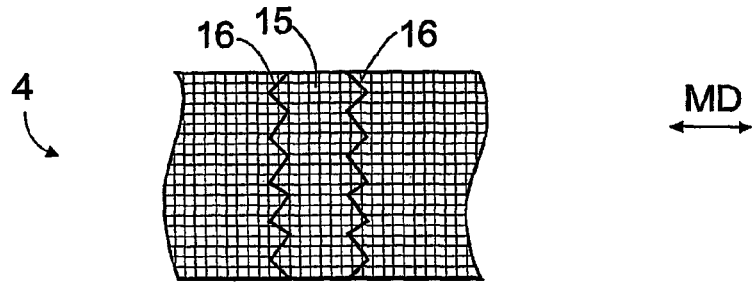
Figure 16:
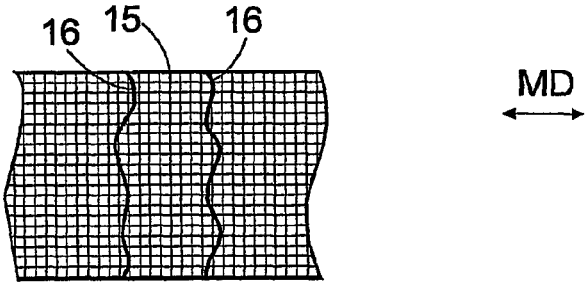

FIGS. 14 to 16 illustrate some shapes of the attachment area 15. The attachment area 15 refers to the portion at and around the seam area 10 where the joining edge areas 11, 12 have been attached to each other. Various welding techniques may be employed in the attachment, such as ultrasonic welding, laser welding, high-frequency welding, hot wedge welding, fusion welding or any other welding method suitable for joining yarns that are at least mainly made of plastic material. In addition, the attachment may be implemented by sewing or using an adhesive, for instance. The boundary surface 16 between the attachment area 15 and the rest of the component can be rendered less distinguishable from the structure by selecting a suitable shape for the attachment area 15. The boundary surface 16 may be linear as shown in FIG. 14 or non-linear as shown in FIGS. 15 and 16. In FIG. 15, the boundary surface 16 is serrated and FIG. 16 shows a boundary surface 16 with a random shape.

Figure 17:
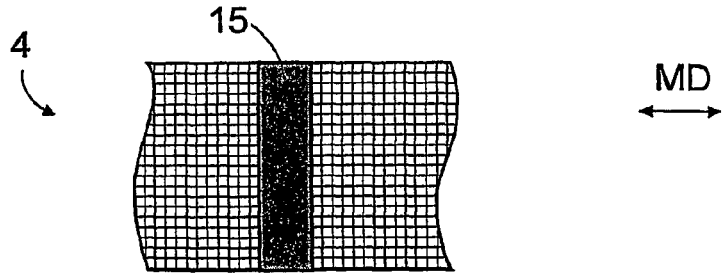
FIGS. 17 and 18 are schematic top views of feasible shapes for a welding mark, and FIG. 19 schematically illustrates yet another way of forming a base fabric.
Figure 18:
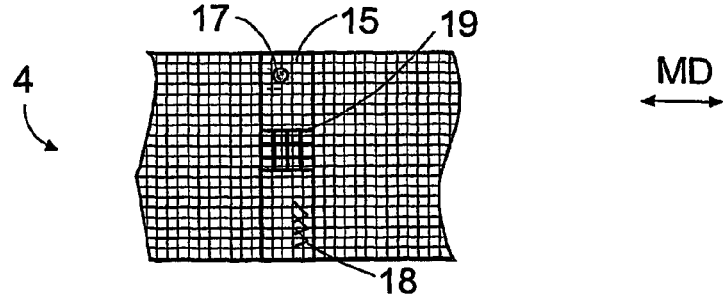

The attachment may be performed substantially over the whole attachment area 15, as illustrated in FIG. 17. Alternatively, particularly when a welding technique is employed, the attachment area 15 may be provided with spotlike attachment points 17 or spotlike or continuous attachment points 18 with a desired shape. It is further feasible to use lattice-shaped attachment points 19, in which case the pattern of the welding seam may substantially correspond to the weave pattern. In that case, the welding seam is not distinguishable from the rest of the structure. The attachment points may be formed such that their number, shape, size or other properties vary in the attachment area 15. Thus the attachment points may vary slidingly, in which case the attachment area 15 cannot be distinguished easily. In addition, the attachment points may be designed so that the permeability in the attachment area 15 does not substantially differ from that in the rest of the component structure. When batt fibre is needled, openings that affect permeability are formed in the attachment area.

Furthermore, attachment may have been performed only at the boundary surfaces 16. The shape of the boundary surface 16 can be selected according to the situation.

When the attachment is implemented by a welding technique, one or more additional yarns can be brought to the attachment area 15, if necessary, or other additional material, such as material that melts at a lower temperature or additional material that improves the absorption of laser welding.

Figure 19:
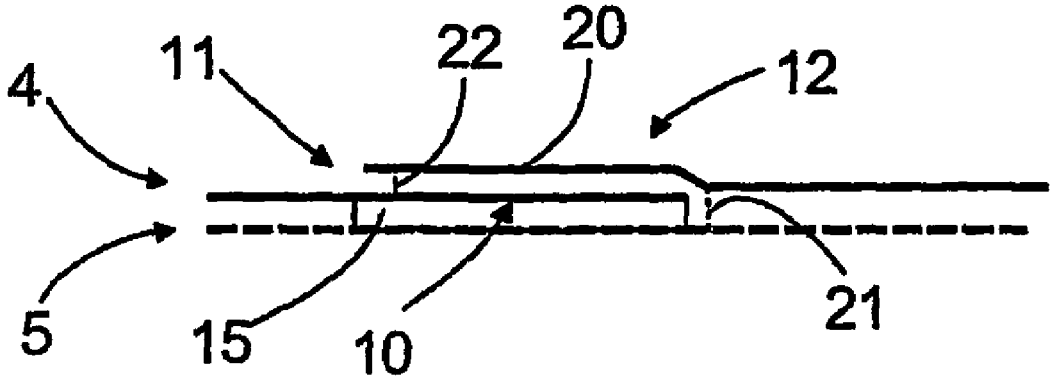

FIG. 19 illustrates a yet another alternative for forming the base fabric 2. The first planar component 4 is arranged on one surface of the second component 5, in this case on top of the component. The first joining edge area 11 and the second joining edge area 12 are superimposed but are not attached to each other before the attachment of batt fibre. Instead, the first joining edge area 11 is attached to the second component 5 at the attachment area 15 undetachably using an attachment method described in this application, for instance. On the other hand, the second joining edge area 12 is not necessarily attached at all but it forms a kind of seam flap 20 in the seam area 10. In some cases, however, the attachment can be performed at points 21 and 22. Even though only one joining edge area 11 had been attached, this would clearly facilitate the handling of the base fabric 2. An overlapping joint with superimposed joining edge areas 11 and 12 is also an essential feature in this embodiment. The second component 5 may have been woven in the form of a closed loop. Alternatively, the second component 5 may have been formed from one or more planar components by weaving, for example. In that case, the planar component is connected into a closed loop by an overlapping joint or suitable joining members.

It is further feasible to provide the planar element 4 with joining edge areas 11, 12 where transverse yarns 7' differ from the transverse yarns 7 in the other portions of the component 4. The joining edge areas 11, 12 may comprise transverse yarns with different dimensions, materials and structures.

The above-mentioned solutions may also be combined to form joining edge areas.

The drawings and the related description are only intended to illustrate the inventive concept. The details of the invention may vary within the scope of the claims.

The invention claimed is:

1. A method of manufacturing a press felt, the method comprising:

forming a base fabric comprising at least one layer, wherein the at least one layer comprises at least a first planar component, which is formed from a plurality of longitudinal yarns that travel in the machine direction and from transverse yarns that travel in the cross machine direction, and the first component is provided with a first transverse joining edge area and a second transverse joining edge area, arranging the first transverse joining edge area and the second transverse joining edge area of the first component to overlap each other and forming a base fabric with the shape of a closed loop, attaching at least one batt fiber layer to the base fabric with the shape of a closed loop, and attaching the joining edge areas undetachably to each other before the attachment of the batt fiber layer, and the method further comprising:

forming at least one thinned joining edge area, where the density of transverse yarns is smaller than in the other portions of the first component, arranging permeability in the overlapping joining edge areas to substantially correspond to that in the rest of the base fabric, and pressing the joining edge areas of the first component against each other during the attachment by a predetermined force so that the thickness of the overlapping joining edge areas substantially corresponds to the thickness of the rest of the first component.

2. A method according to claim 1, comprising providing, when the first component is formed, at least one joining edge area of the component with a smaller density of transverse yarns than the rest of the first component.

3. A method according to claim 1, comprising forming a thinned first joining edge area and a second joining edge area in the first component.

4. A method according to claim 1, comprising attaching the overlapping joining edge areas to each other by welding.

5. A method according to claim 1, wherein the first planar component of the base fabric is manufactured by weaving and its width substantially corresponds to the width of the press felt.

6. A method of manufacturing a press felt, the method comprising forming a base fabric comprising at least one layer, wherein the at least one layer comprises at least a first planar component, which is formed from a plurality of longitudinal yarns that travel in the machine direction and from transverse yarns that travel in the cross machine direction, and the first component is provided with a first transverse joining edge area and a second transverse joining edge area, arranging the first transverse joining edge area and the second transverse joining edge area of the first component to overlap each other and forming a base fabric with the shape of a closed loop, attaching at least one batt fiber layer to the base fabric with the shape of a closed loop, and attaching the joining edge areas undetachably to each other before the attachment of the batt fiber layer, and the method further comprising forming at least one thinned joining edge area, where the density of transverse yarns is smaller than in the other portions of the first component, arranging permeability in the overlapping joining edge areas to substantially correspond to that in the rest of the base fabric, pressing the joining edge areas of the first component against each other during the attachment by a predetermined force so that the thickness of the overlapping joining edge areas substantially corresponds to the thickness of the rest of the first component, and forming at least a second component with the shape of a closed loop, arranging the first component on top of the second component, and connecting the joining edge areas of the first component with an overlapping joint.

7. A press felt for a paper machine press section, the press felt comprising:

a base fabric comprising at least one layer, which comprises a plurality of longitudinal yarns that travel in the machine direction and a plurality of transverse yams that travel in the cross machine direction and wherein the at least one layer comprises at least a first planar component, which includes a first transverse joining edge area and a second transverse joining edge area and where the joining edge areas have been connected to each other; and at least one batt fiber layer, and wherein the first joining edge area and the second joining edge area of the first component have been arranged to overlap each other, the joining edge areas have been attached to each other undetachably before the attachment of the batt fiber layer, the density of transverse yarns is smaller at least in one joining edge area of the first component than in the rest of the first component, the joining edge areas of the first component have been pressed against each other, the thickness of the overlapping joining edge areas substantially corresponds to the thickness of the rest of the first component, and the permeability in the overlapping joining edge areas substantially corresponds to the permeability of the rest of the base fabric.

8. A base fabric for a press felt, comprising:

a plurality of longitudinal yarns that travel in the machine direction;

a plurality of transverse yarns that travel in the cross machine direction;

at least a first planar component in at least one layer of the base fabric, and the first component comprises at least a first transverse joining edge area and a second transverse joining edge area, and where the joining edge areas have been connected to each other, and where the first joining edge area and the second joining edge area of the first component have been arranged to overlap each other;

the joining edge areas have been attached to each other undetachably, and wherein at least one joining edge area of the first component has a smaller density of transverse yarns than the rest of the first component, the joining edge areas of the first component have been pressed against each other, the thickness of the overlapping joining edge areas substantially corresponds to the thickness of the rest of the first component, and the permeability in the overlapping joining edge areas substantially corresponds to the permeability of the rest of the base fabric.

9. A base fabric according to claim 8, wherein the joining edge areas of the first component are attached to each other by welding.

10. A press felt for a paper machine press section, the press felt comprising:

a base fabric, which comprises a plurality of longitudinal yams that travel in the machine direction and a plurality of transverse yarns that travel in the cross machine direction and whose at least one layer comprises at least a first planar component, which includes a first transverse joining edge area and a second transverse joining edge area and where the joining edge areas have been connected to each other; and at least one batt fiber layer, and wherein the first joining edge area and the second joining edge area of the first component have been arranged to overlap each other, the joining edge areas have been attached to each other undetachably before the attachment of the batt fiber layer, the density of transverse yarns is smaller at least in one joining edge area of the first component than in the rest of the first component, the joining edge areas of the first component have been pressed against each other, the thickness of the overlapping joining edge areas substantially corresponds to the thickness of the rest of the first component, the permeability in the overlapping joining edge areas substantially corresponds to the permeability of the rest of the base fabric, and wherein the base fabric further comprises a second component having a shape of a closed loop, and wherein the first component is located on top of the second component.

11. A base fabric for a press felt, comprising:

a plurality of longitudinal yarns that travel in the machine direction;

a plurality of transverse yarns that travel in the cross machine direction;

at least a first planar component in at least one layer of the base fabric, and the first component comprises at least a first transverse joining edge area and a second transverse joining edge area, and where the joining edge areas have been connected to each other, and where the first joining edge area and the second joining edge area of the first component have been arranged to overlap each other;

the joining edge areas have been attached to each other undetachably, and wherein at least one joining edge area of the first component has a smaller density of transverse yarns than the rest of the first component, the joining edge areas of the first component have been pressed against each other, the thickness of the overlapping joining edge areas substantially corresponds to the thickness of the rest of the first component, the permeability in the overlapping joining edge areas substantially corresponds to the permeability of the rest of the base fabric, and wherein the base fabric further comprises a second component having a shape of a closed loop, and wherein the first component is located on top of the second component.

12. A method of manufacturing a press felt, the method comprising:

forming a base fabric comprising at least one layer, wherein the at least one layer comprises at least a first planar component, which is formed from a plurality of longitudinal yarns that travel in the machine direction and from transverse yarns that travel in the cross machine direction, and the first component is provided with a first transverse joining edge area and a second transverse joining edge area, arranging the first transverse joining edge area and the second transverse joining edge area of the first component to overlap each other and forming a base fabric with the shape of a closed loop, attaching at least one batt fiber layer to the base fabric with the shape of a closed loop, and attaching the joining edge areas undetachably to each other before the attachment of the batt fiber layer, and the method further comprising:

forming at least one thinned joining edge area, where the density of transverse yarns is smaller than in the other portions of the first component, removing transverse yarns from at least one joining edge area of the first component from a portion having a length of between 5 and 20 mm, arranging permeability in the overlapping joining edge areas to substantially correspond to that in the rest of the base fabric, and pressing the joining edge areas of the first component against each other during the attachment by a predetermined force so that the thickness of the overlapping joining edge areas substantially corresponds to the thickness of the rest of the first component.

13. A method of manufacturing a press felt, the method comprising:

forming a base fabric comprising at least one layer, wherein the at least one layer comprises at least a first planar component, which is formed from a plurality of longitudinal yarns that travel in the machine direction and from transverse yarns that travel in the cross machine direction, and the first component is provided with a first transverse joining edge area and a second transverse joining edge area, arranging the first transverse joining edge area and the second transverse joining edge area of the first component to overlap each other and forming a base fabric with the shape of a closed loop, providing at least the portion of the overlapping joining edge areas with an attachment area, where the joining edge areas are attached to each other undetachably, and making the boundary surface between the attachment area and the rest of the first component non-linear, attaching at least one batt fiber layer to the base fabric with the shape of a closed loop, and attaching the joining edge areas undetachably to each other before the attachment of the batt fiber layer, and the method further comprising:

forming at least one thinned joining edge area, where the density of transverse yarns is smaller than in the other portions of the first component, arranging permeability in the overlapping joining edge areas to substantially correspond to that in the rest of the base fabric, and pressing the joining edge areas of the first component against each other during the attachment by a predetermined force so that the thickness of the overlapping joining edge areas substantially corresponds to the thickness of the rest of the first component.

14. A method of manufacturing a press felt, the method comprising:

forming a base fabric comprising at least one layer, wherein the at least one layer comprises at least a first planar component, which is formed from a plurality of longitudinal yarns that travel in the machine direction and from transverse yarns that travel in the cross machine direction, and the first component is provided with a first transverse joining edge area and a second transverse joining edge area, arranging the first transverse joining edge area and the second transverse joining edge area of the first component to overlap each other and forming a base fabric with the shape of a closed loop, providing at least the portion of the overlapping joining edge areas with an attachment area, where the joining edge areas are attached to each other undetachably, and providing the attachment area with several attachment points, which form a pattern that imitates the pattern of the base fabric surface, attaching at least one batt fiber layer to the base fabric with the shape of a closed loop, and attaching the joining edge areas undetachably to each other before the attachment of the batt fiber layer, and the method further comprising:

forming at least one thinned joining edge area, where the density of transverse yarns is smaller than in the other portions of the first component, arranging permeability in the overlapping joining edge areas to substantially correspond to that in the rest of the base fabric, and pressing the joining edge areas of the first component against each other during the attachment by a predetermined force so that the thickness of the overlapping joining edge areas substantially corresponds to the thickness of the rest of the first component.

15. A press felt for a paper machine press section, the press felt comprising:

a base fabric comprising at least one layer, which comprises a plurality of longitudinal yarns that travel in the machine direction and a plurality of transverse yarns that travel in the cross machine direction and wherein the at least one layer comprises at least a first planar component, which includes a first transverse joining edge area and a second transverse joining edge area and where the joining edge areas have been connected to each other; and at least one batt fiber layer, and wherein the first joining edge area and the second joining edge area of the first component have been arranged to overlap each other, the joining edge areas have been attached to each other undetachably before the attachment of the batt fiber layer, the density of transverse yarns is smaller at least in one joining edge area of the first component than in the rest of the first component, transverse yarns are removed from at least one joining edge area of the first component from a portion having a length of between 5 and 20 mm, the joining edge areas of the first component have been pressed against each other, the thickness of the overlapping joining edge areas substantially corresponds to the thickness of the rest of the first component, and the permeability in the overlapping joining edge areas substantially corresponds to the permeability of the rest of the base fabric.

16. A press felt according to claim 15, wherein at least one joining edge area of the first component is provided with a smaller density of transverse yarns than the rest of the first component during the manufacture.

17. A press felt according to claim 15, wherein the joining edge areas of the first component have been attached to each other by welding.

18. A press felt according to claim 15, wherein the width of the overlapping area of the joining edge areas of the first component is 5 to 20 mm in the machine direction.

* * * * *